US005087921A

United States Patent [19]

Kurtz

[11] Patent Number: 5,087,921

[45] Date of Patent: Feb. 11, 1992

[54] ARRAY BEAM POSITION CONTROL USING COMPOUND SLOTS

[75] Inventor: Louis A. Kurtz, Woodland Hills, Calif.

[73] Assignee: Hughes Aircraft Company, Los Angeles, Calif.

[21] Appl. No.: 492,216

[22] Filed: Mar. 13, 1990

Related U.S. Application Data

[63] Continuation of Ser. No. 322,254, Mar. 10, 1989, abandoned, which is a continuation of Ser. No. 919,930, Oct. 17, 1986, abandoned.

[51] Int. Cl.[5] ..... H01Q 13/10

[52] U.S. Cl. ..... 343/771; 343/731

[58] Field of Search ..... 343/771, 770, 767, 768, 343/731, 308

[56] References Cited

U.S. PATENT DOCUMENTS

| | | | |
|---|---|---|---|
| 2,596,480 | 5/1952 | Guptill et al. | 343/771 |
| 2,981,944 | 4/1961 | Washburne | 343/768 |
| 3,005,984 | 10/1961 | Winter et al. | 343/768 |
| 3,183,511 | 5/1965 | Ajioka | 343/767 |
| 3,204,242 | 8/1965 | Goebels, Jr. | 343/768 |
| 3,340,534 | 9/1967 | Fee | 343/767 |
| 3,509,571 | 4/1970 | Jones, Jr. et al. | 343/771 |
| 3,530,479 | 9/1970 | Waldron | 343/767 |
| 3,604,010 | 9/1971 | Schwartz et al. | 343/768 |
| 3,829,862 | 8/1974 | Young | 343/767 |
| 3,848,256 | 11/1974 | Craven et al. | 343/771 X |
| 3,931,624 | 1/1976 | Hundley et al. | 343/768 |
| 4,164,742 | 8/1979 | Nemit | 343/768 |
| 4,257,050 | 3/1981 | Ploussios | 343/854 |
| 4,348,681 | 9/1982 | McVeigh et al. | 343/854 |
| 4,371,876 | 2/1983 | Nash | 343/768 |

OTHER PUBLICATIONS

Maxum, "Resonant Slots with Independent Control of Amplitude and Phase", IRE Trans. on Antenna and Propagation, vol. AP-26, No. 2, Mar. 1978, pp. 384-389.

Elliot, "An Improved Design Procedure for Small Arrays of Shunt Slots", IEEE Trans. on Antennas and Propagation, vol. AP-31, No. 1, Jan. 1983.

*Primary Examiner*—Eugene R. LaRoche
*Assistant Examiner*—Seung Ham
*Attorney, Agent, or Firm*—R. M. Heald; C. D. Brown; W. K. Denson-Low

[57] ABSTRACT

A waveguide slotted array is disclosed, employing compound slots in a waveguide broad wall. The phase of the voltage excited in the slot is controlled by the slot offset and angle of inclination relative to the axis. Utilization of the additional phase control provided by the compound slots allows the beam of a traveling wave slot array to be placed far from broadside, without the need to operate the array at frequencies so close to the waveguide cutoff frequency that there is unacceptable frequency sensitivity. The beam may be placed at any angle independently of which end of the array contains the input and which end the load.

6 Claims, 5 Drawing Sheets

ARRAY BEAM POSITION CONTROL USING COMPOUND SLOTS

This application is a continuation of application Ser. No. 322,254, filed Mar. 10, 1989 (now abandoned) which is a continuation of application Ser. No. 919,930, filed Oct. 17, 1986 (now abandoned).

BACKGROUND OF THE INVENTION

The present invention relates to slotted waveguide arrays, and more particularly to an array employing compound slots to provide control of the beam position.

Two types of slotted waveguide arrays in common use are the serpentine slot array and the shunt slot array. In both types of array, the waveguide must be operated at wavelengths close to the waveguide cutoff wavelength if the beam is to be tilted far off broadside. Thus, the beam is scanned as the exciting frequency is scanned.

There is therefore a need to provide a slotted waveguide array which allows the beam position to be chosen independently of the waveguide size, such that it is not necessary to operate the array at wavelengths approaching the cut off wavelength of the waveguide.

The properties of the general inclined-displaced slot (i.e., the compound slot) are described in "The Physical Principles of Waveguide Transmission and Antenna Systems," by W. H. Watson, Oxford at the Claredon Press, 1947. Watson apparently used the special properties of these slots to build a traveling wave array in which each slot could be matched with a tuning button so that the array would operate through the broadside frequency without the customary high VSWR. Insofar as is known, however, Watson did not use the phase properties of compound slots to scan the beam.

In the paper "Resonant Slots with Independent Control of Amplitude and Phase," B. J. Maxum, IEEE Trans. Antennas and Propagation, Vol. AP-8, pp. 384–389, July, 1960, a linear array is described in which the phase properties of compound slots are employed to achieve a particular shaped beam, wherein the coupling coefficients are limited to small values because of approximations involved in the analysis.

It would therefore represent an advance in the art to provide a traveling wave slotted waveguide array which allows the beam position to be chosen independently of the waveguide size, and without operating the array at wavelengths close to the waveguide cut off frequencies.

It would further be an advantage to provide a slotted waveguide array employing compound slots to achieve a desired beam position.

SUMMARY OF THE INVENTION

The above advantages and objectives are achieved in a slotted waveguide array employing compound slots, wherein the phase of the voltage in a broadwall-waveguide-fed slot is controlled by the offset and angle of inclination of the slot relative to the longitudinal axis of the waveguide. With the phase control provided by the compound slots, the beam resulting from an excitation signal propagating through the waveguide as the $TE_{10}$ mode may be directed at a desired direction relative to the broadside.

A preferred embodiment comprises a rectangular waveguide defined by first and second conductive broadwalls and first and second conductive narrow-walls, and a plurality of compound slots formed in said first broadwall. The inclination of each slot and its offset from the longitudinal axis is determined by the required voltage phase and amplitude distribution to produce the desired beam direction. Each slot is of resonant length. One end of the waveguide is terminated in a matched load.

The invention allows the beam to be placed far from the broadside direction without the need to operate so close to the waveguide cutoff frequency that there is unacceptable frequency sensitivity.

BRIEF DESCRIPTION OF THE DRAWINGS

These and other features and advantages of the present invention will become more apparent from the following detailed description of an exemplary embodiment thereof, as illustrated in the accompanying drawings, in which.

DETAILED DESCRIPTION OF THE DISCLOSURE

The presently preferred embodiment of the invention is a slotted waveguide array comprising a waveguide having a plurality of compound slots formed along one broadwall. Certain basic principles of the invention may be appreciated with respect to FIGS. 1A and 1B, showing plan views of various slots formed in waveguide 20 (FIG. 1A) and 30 (FIG. 1B).

Figure 1A:
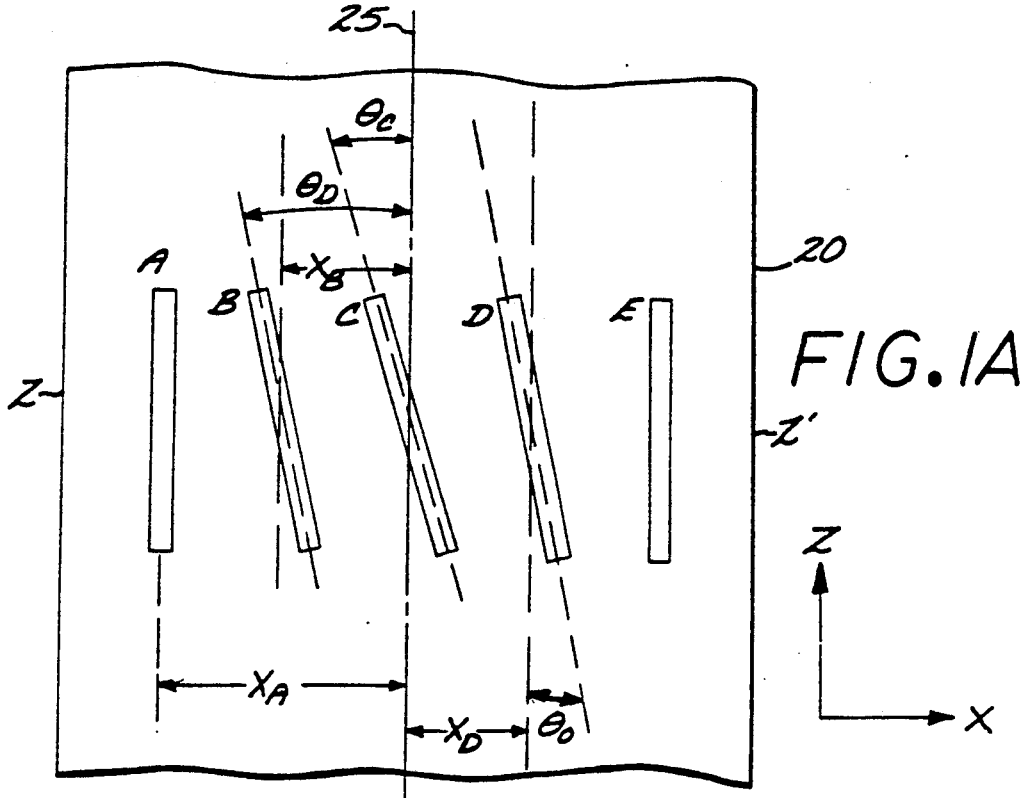
FIGS. 1A and 1B are diagrammatic illustrations of shunt, series and compound slots in the broadwall of a rectangular waveguide.
Figure 1B:
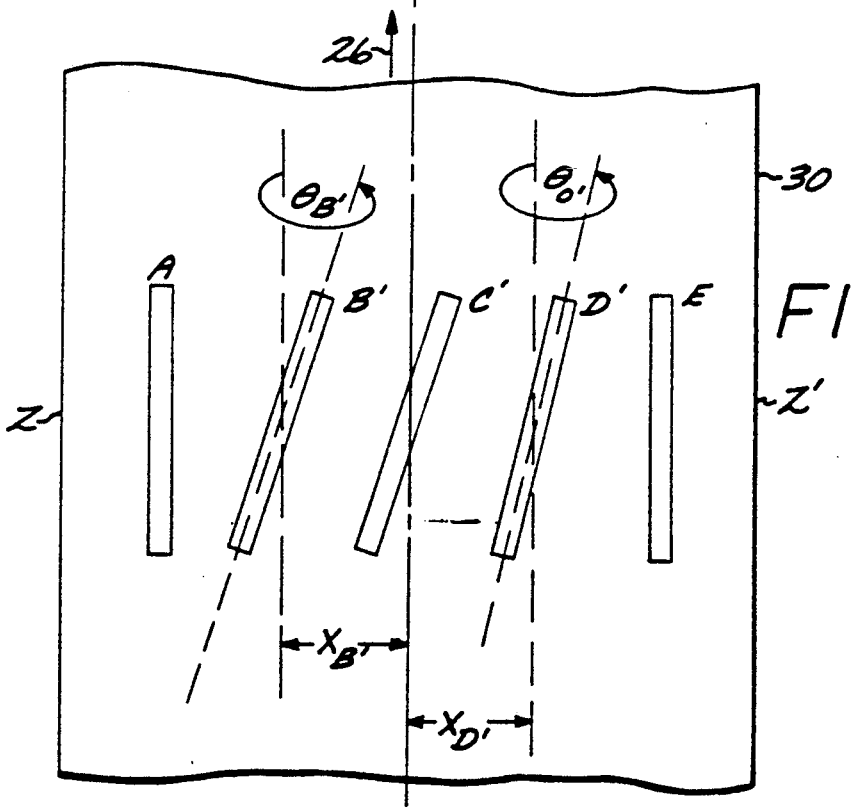
Figure 2A:
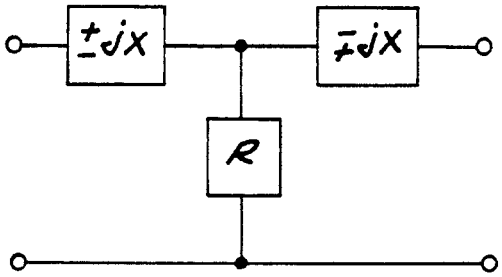
FIGS. 2A–2C represent respective equivalent circuits of the resonant compound slot, the shunt slot and the series slot.
Figure 2B:
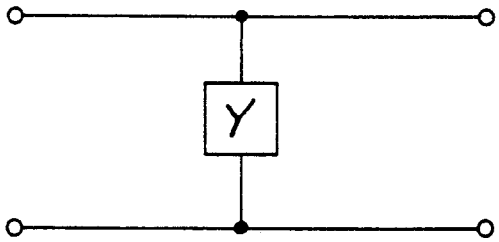
Figure 2C:
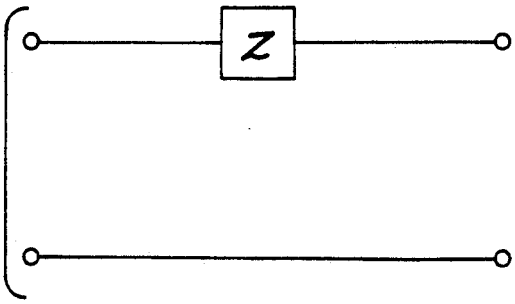

Compound slots, such as slots B and D in FIG. 1A, and B′ and D′ in FIG. 1B, are both offset and tilted or inclined with respect to the centerline 25 of the broad wall. The equivalent circuit of the resonant compound slot is a "T" network as shown in FIG. 2A. By contrast, slots A and E are aligned in parallel with, but offset from, the axis 25, and therefore may be represented by pure shunt admittance as shown in FIG. 2B. Slots C and C′ are disposed on the axis 25, but inclined with respect thereto, and therefore may be represented as pure series impedance as shown in FIG. 2c.

An attractive feature of compound slots can be appreciated by the following analysis. Suppose that all slots shown in FIGS. 1A and 1B are of a resonant length (one-half the wavelength of the exciting energy). Then if an excitation signal of a $TE_{10}$ mode of unit amplitude and zero phase (referenced at the cross section Z-Z′) is incident on any of these slots, traveling in the direction of arrow 26 through the waveguides 20, 30, the electric field induced in slot A will have an amplitude governed by its offset $X_A$ from axis 25 and a phase of +90°. The electric field induced in slot E will have the same amplitude as in slot A, but the phase will be −90°. The electric field induced in slot C will have an amplitude governed by its its inclination $\theta_c$ from the axis 25 and a phase of 0°.

Since compound slots B and D may be viewed as transitions from slot A to slot C and from slot C to slot E, respectively, it follows that the phase of the electric fields induced in compound slot B and D will lie in the range (90°, 0°) and (0°, −90°), respectively. The amplitudes and phases of these induced fields will depend on both the respective offsets $X_B$, $X_D$ and inclinations $\theta_B$, $\theta_D$ of slots B and D.

In a similar fashion, since the phase of the electric field in slot C' is 180°, the phases of the induced fields in compound slots B' and D' will lie in the ranges (90°, 180°) and (180°, −90°), respectively. The amplitudes and phases of these induced fields will depend on both the offsets $X_{B'}$, $X_{D'}$ and inclinations $\theta_{B'}$, $\theta_{D'}$ of slots B' and D'.

From the foregoing, the important conclusion is reached that the phase of the electric field induced in a resonant compound slot by an incident $TE_{10}$ mode excitation signal can be adjusted through a full range of 360° by choice of the slot offset and inclination. This conclusion suggests that the compound slot can be used for total phase control in an array, i.e., not only to adjust the phase needed to scan the beam to a given angle, but also to incorporate the phase corrections needed to compensate for the effects of mutual coupling. The design of slot arrays which include the effects of mutual coupling are reported in the papers "The Design of Small Slot Arrays," IEEE Trans. Antennas and Propagation, Vol. AP-26, pages 214–219, March, 1978, by L. A. Kurtz and R. S. Elliot, and "Design of Inclined Series Slot Arrays," by M. Orefice and R. S. Elliot, UCLA Department of Electrical Sciences Report, October, 1979. In those designs, equivalent dipole arrays were introduced via Babinet's principle and an aperture-excitation-weighted sum of dipole initial impedances was seen to represent the mutual coupling. The lengths of the dipoles, and thus the slots, were adjusted so that the sum of the loaded dipole self-impedance and the mutual coupling term was pure real and at a level to produce the proper excitation and input match. Thus, for shunt slot arrays, the design parameters were ($X_n$, $2L_n$), with $X_n$ and $2L_n$ representing the offset and length, respectively, of the nth slot. For series slot arrays, the design parameters were ($\theta_n$, $2L_n$), with $\theta_n$ and $2L_n$ representing the inclination and length, respectively, of the nth slot.

In contrast to these earlier designs, the invention employs resonant-length compound slots, and adjusts the two design parameters $X_n$ and $\theta_n$ to account for the effects of mutual coupling, as well as adjusting the phase required by the beam scan angle.

Figure 3:
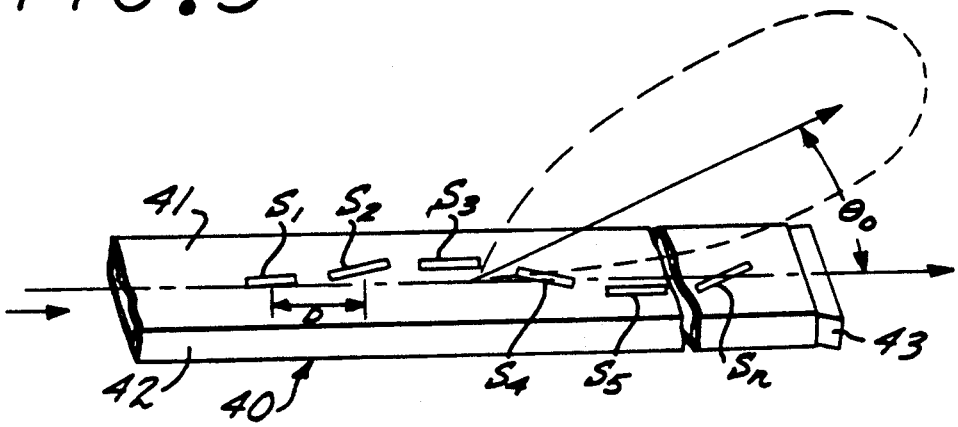
FIG. 3 is a diagrammatic illustration of a waveguide section having a plurality of compound slots formed therein.

Arrays of resonant compound slots possess a significant advantage when used in an important class of applications where shunt and series slots are unsatisfactory, i.e., traveling wave arrays. These advantages may be appreciated with reference to FIG. 3, wherein rectangular waveguide 40 has an array of slots $S_1$–$S_n$ formed in one of its broad walls 41. The waveguide 40 is terminated in a load 43. Assume that the excitation of successive slots is by a $TE_{10}$ mode whose amplitude is essentially the same at the successive slots, but whose phase differs by $B_{10}d$ radians at the two slots with d the slot spacing and $B_{10}$ the phase velocity of the mode ($2\pi/\lambda_g$). The aperture excitation has a natural phase progression such that the main beam will point at an angle $\theta_o$ off endfire given by kd cos $\theta_o = B_{10}d$, where $k = 2\pi/\lambda_o$ (without consideration of the additional phase control which may be provided by the compound slots). Hence $\theta_o = \text{arc cos}(B_{10}/k)$. The broad wall 41 dimension of the waveguide 40 could conceivably be adjusted to accommodate any $B_{10}/k$, and thus any beam pointing direction $\theta_o$. This is not a practical possibility where size limitations and frequency sensitivity are considerations.

The present invention provides a solution to the problem of how to provide, in a traveling wave array, an aperture excitation with a phase progression from slot to slot other than $B_{10}d$, so that the beam can be placed at an angular position other than the natural one. Theoretically this could be by adjusting the slot length of pure series or shunt slots to provide a phase difference which, when added to the phase progression to the aperture excitation places the beam at a desired angle $\theta$. However, for arrays of practical length, there is not enough dynamic range to the self-admittance or self-impedance to permit this phase increment to be substantial. Compound slots do not suffer from this limitation, since they permit a full phase range of 360° in the excitation of individual slots. The orientation of the compound slot adds an additional phase shift $\alpha$ so that the beam position $\theta_o$ (FIG. 3) is now determined by the relationship of Eq. 1.

$$\cos\theta_o = B_{10}/k + \alpha/kd \tag{1}$$

As a result, a traveling wave slot array employing compound slots may provide a beam at very near endfire (90° from the broadside) without requiring an excitation signal near the waveguide cutoff wavelength.

An exemplary design procedure for designing a particular compound slot array is now described in summary fashion. It is assumed that the waveguide size, slot spacing, frequency of operation and dielectric constant of the dielectric filling of the waveguide have all been selected. In this example, there are N resonant length compound slots in the array, with a common spacing d, and with the nth slot furthest from the excitation source. It is further assumed that the desired radiation pattern has been specified so that the total voltage in each slot has been determined in relative amplitude and phase using known techniques.

The total voltage in the nth slot is designated as $V_n^s$ and is composed of four components, $$V_n^s = V_{n1}^s + V_{n2}^s + V_{n3}^s + V_{n4}^s \tag{3}$$

in which $V_{n1}^s$ = slot voltage due to wave $A_n$ incident from left, i.e., from $z < z_n^o$ $V_{n2}^s$ = partial slot voltage due to wave $D_n$ incident from right, i.e., from $z > z_n^o$.

$V_{n3}^s$ = partial slot voltage due to external mutual coupling with all other slots in the array.

$V_{n4}^s$ = partial slot voltage due to internal $TE_{20}$ mode coupling with two immediate neighbor slots in the same waveguide.

Similarly, the total backward-scattered and forward-scattered $TE_{10}$ modes off the nth slot will have amplitudes $B_n$ and $C_n$ which can be shown in corresponding parts, viz., $$B_n = B_{n1} + B_{n2} + B_{n3} + B_{n4} \quad (4)$$

$$C_n = C_{n1} + C_{n2} + C_{n3} + C_{n4} \quad (5)$$

The relationships which connect the quantities of Eqs. 4 and 5 are given in the Appendix.

The central design equation which leads ultimately to a relationship between the desired slot voltages and the slot offset ($x_n$) from the waveguide centerline and its angle of inclination ($\theta_n$) thereto is as follows:

$$\frac{V_n^s}{K_{1,n}}\left[\left(1 - \frac{V_{n,3}^s}{V_n^s} - \frac{V_{n4}^s}{V_n^s}\right)(1 + K_{2,n}h_nh_n^*) - K_{2,n}h_nh_n^*\right] = h_n^*A_{n+1}\,e^{jB10d} - h_n(B_{n+1} + D_{n+1})e^{-jB10d} \quad (6)$$

In the above, $$K_{1,n} = \frac{\eta a}{2}\left[\frac{(4L_n/\lambda)}{f_{3,n}}\right]$$

$$K_{2,n} = \frac{k_oL_n}{(B_{10}/k)(k_oa)(k_ob)}\left(\frac{(4L_n/\lambda)}{f_{3,n}}\right),$$

with $\eta$ the impedance of free space, $\lambda = \lambda_o/(\epsilon_r)^{\frac{1}{2}}$ and the wavelength of plane waves traveling in an unbounded region of dielectric constant $\epsilon_r = \epsilon/\epsilon_o$.

$$f_{3,n} = \left(\frac{4L_n}{\lambda_o}\right)^2 \int_o^{\frac{\pi}{2}} \left[\frac{\cos(k_oL_n\cos\theta)}{1 - (4L_n/\lambda_o)^2\cos^2\theta}\right]^2 \sin^3(\theta)\,d\theta \simeq 0.609\left(\frac{4L_n}{\lambda_o}\right)^2$$

The key term relating to the slot orientation is $h_n(X_n, \theta_n, 2L_n)$. This term is $$h_n(x_n, \theta_n, 2L_n) = f_1(\theta_n, 2L_n)\sin(\theta_n + i)\,e^{-j\frac{fx_n}{a}} + f_2(\theta_n, 2L_n)\sin(\theta_n - i)\,e^{j\frac{\pi x_n}{a}} \quad (7)$$

with $2L_n$ the resonant length of the nth compound slot. $2L_n$ is a function of the offset of the $n^{th}$ slot and perhaps also its inclination. In Eq. 7, $i = \arcsin(\lambda/2a)$ and $$f_1(\theta_n, 2L_n) = \frac{\cos(v_1k_1L_n)}{1 - (4v_1L_n/\lambda)^2}$$

$$f_2(\theta_n, 2L_n) = \frac{\cos(v_2k_2L_n)}{1 - (4v_2L_n/\lambda)^2}$$

with $$\left.\begin{matrix} v_1 \\ v_2 \end{matrix}\right\} = \frac{\beta_{10}}{k}\cos(\theta_n) \mp \frac{\lambda}{a}\sin(\theta_n)$$

To solve the central design equation (Eq. 6) shown above the constants $L_n$, $K_{l,n}$, and $K_{2,n}$ are given initial values. Also the external and internal mutual couplings, $V_{n,3}^s$, and $V_{n,4}^s$, are calculated for these initial values. The central design equation thus yields a value from $H_n$ which leads to new values of $X_n$ and $\theta_n$. This process is repeated with each iteration drawing closer to the true values of $X_n$ and $\theta_n$.

The compound slots employed in the preferred embodiment of the invention are of resonant length. As is known to those skilled in the art, the resonant length is a parameter which may be determined emperically by measurements or in some cases by calculation using a method of moments technique. It has been found that a reasonable approximation of the resonant length parameter is that of a pure shunt slot with the same offset as the particular compound slot. The central design equation (Eq. 6) has been tested against experiments performed on two S-band antennas. Each of these antennas consisted of nine compound slots, 0.55 $\lambda_o$ on centers, traveling-wave fed by a $TE_{10}$ wave dielectric-filled waveguide. Each waveguide was terminated in a matched load which absorbed 10% of the input power. The waveguide broadwall dimension is 1.3 inches, and the narrow wall dimension is 0.150 inches. The waveguide was filled with a dielectric material having a dielectric constant of 2.5. The waveguides are fabricated from Duroid 5876, a stripline board material which is copper clad on both sides, with the abutting edges copper clad to form a closed waveguide. Both of these antennas had been designed by employing an earlier, less-exact design procedure. The array were designed to produce main beams at 60° and 120°, respectively, from forward endfire, defined as being in the direction from the input to the load.

The dimensions and orientations of the nine slots $S_i$ of the slotted array designed for producing the main beam at 60° from forward endfire are given by way of example in Table I.

TABLE I

| Slot # | $X_n$ (inches) | $\Theta_n$ (degrees) | Length (inches) |
|---|---|---|---|
| 1 | +.003 | −.76° | 1.172 |
| 2 | +.018 | −.35° | 1.174 |
| 3 | +.022 | +1.4° | 1.175 |
| 4 | 0.0 | +3.8° | 1.172 |
| 5 | −.038 | +3.3° | 1.181 |
| 6 | −.069 | −1.0° | 1.200 |
| 7 | −.052 | −5.5° | 1.188 |
| 8 | +.011 | −5.2° | 1.173 |
| 9 | +0.41 | −2.3° | 1.182 |

Figure 4A:
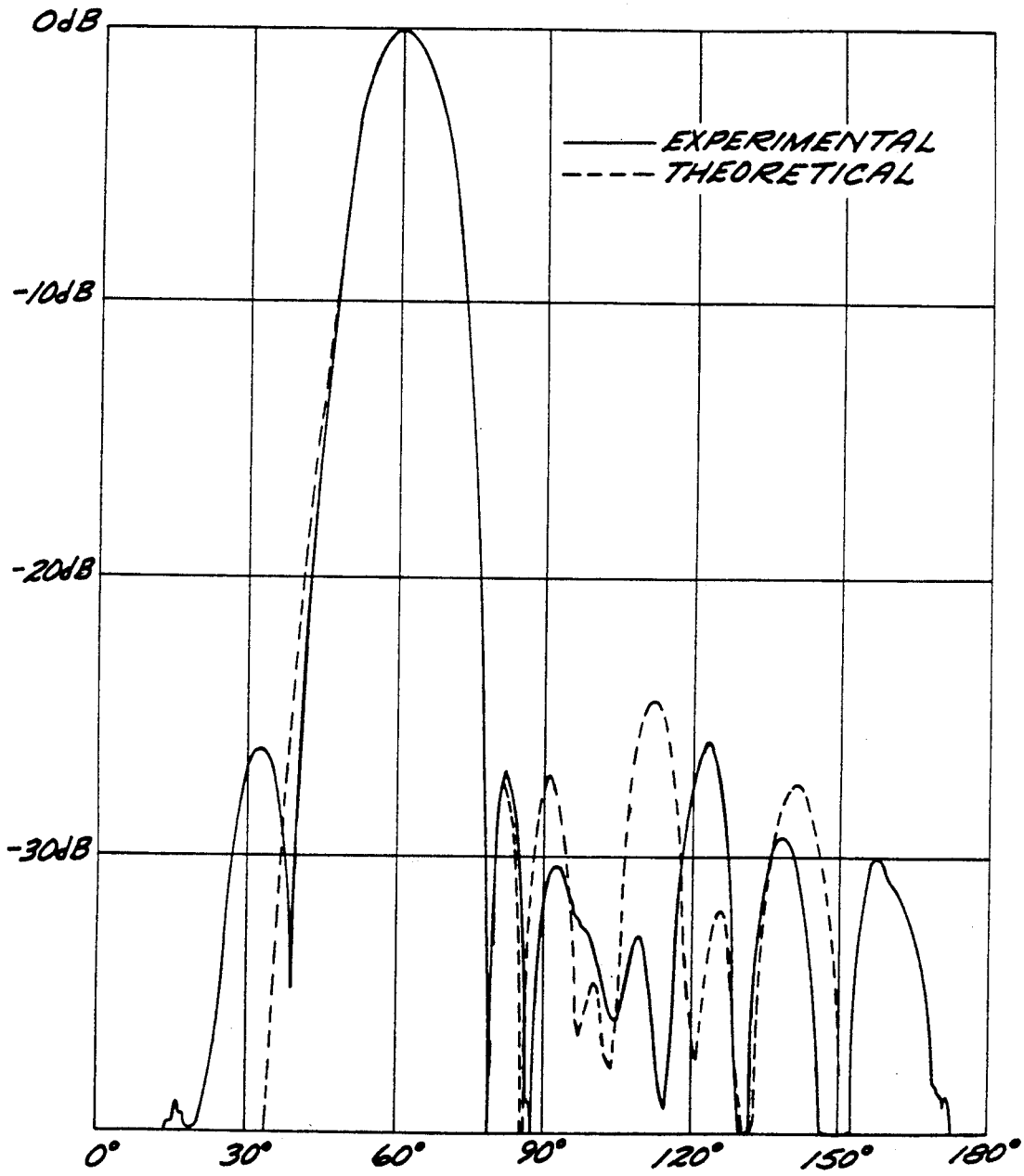
FIGS. 4A and 4B are plots of the radiation pattern for a traveling wave array embodying the invention with nine resonant slots fed by a dielectric filled waveguide for the forward beam and backfire cases, with the solid line depicting experimental patterns and the dashed line representing the expected theoretical patterns.
Figure 4B:
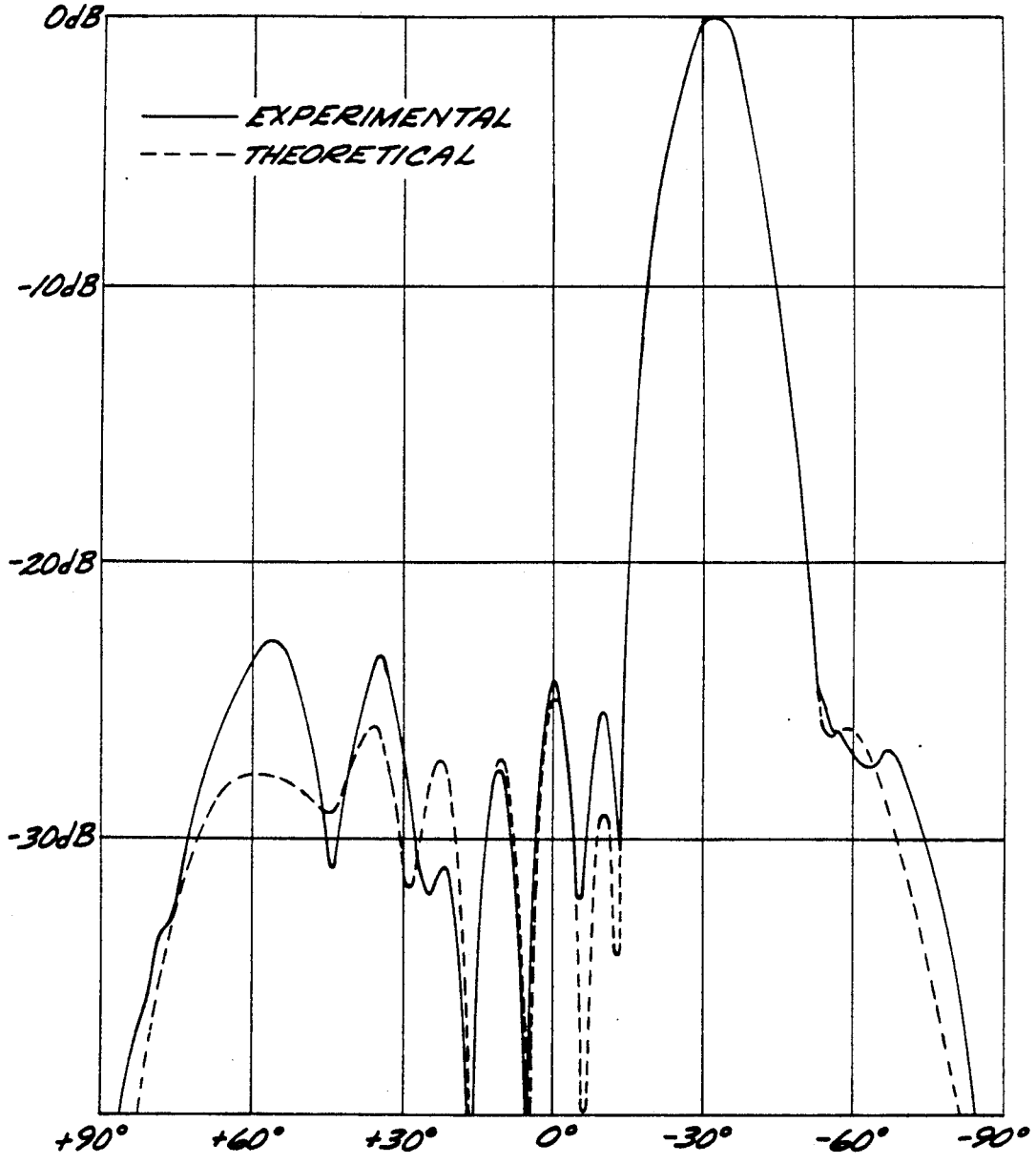

The intended aperture distributions were the Taylor −30 dB, $\bar{n}=6$ distribution. With the main beam ±30° off broadside, and with the element factor included, this results in a theoretical side lobe level of −26 dB. The experimental patterns for these antennas are shown in FIGS. 4A and 4B are compared with patterns calculated using the actual slot dimensions and the corrected design equation set forth above. A unique feature of arrays embodying the invention is that the beams of the two antennas are on opposite sides of broadside while the waveguide size and slot spacing are identical. Only the slot orientations are different.

The above examples are for arrays which produce beams at ±60° and 120°, respectively, from forward endfire, or ±30° from broadside. It is to be understood that the maximum beam scan angle achievable by the invention is limited only by the shape of the radiation patterns of the slot elements and the onset of secondary beams, and not by any limitation on achievable interelement phase shifts. As will be appreciated by those skilled in the art, the longer the array is, the narrower the beam and the closer it may be scanned to endfire.

Figure 5:
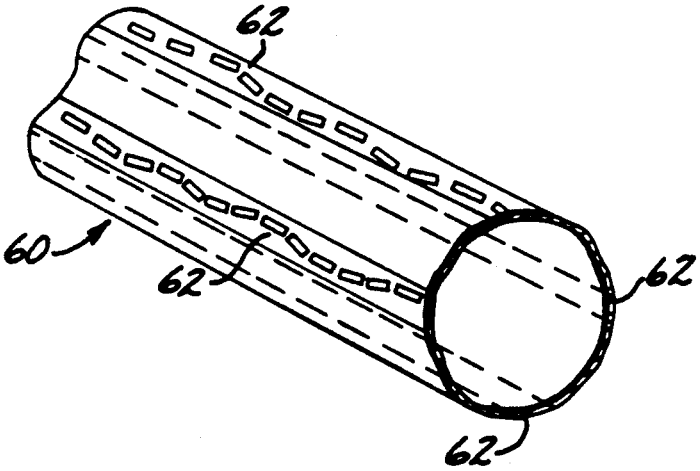
FIG. 5 is a diagrammatic view illustrating a missile body having a plurality of traveling wave arrays embodying the invention disposed along the periphery thereof.

One application to which the invention is particularly well suited is as a missile target detection device (TDD) or fuse antenna. A simplified perspective diagrammatic view of a portion of a missile body with the slotted arrays is shown in FIG. 5. One or more of the slotted arrays 62 designed to place the beam far from broadside may be arranged longitudinally along the outer surface of the missile body 60. The beam of these antennas may be used to detect targets being approached by the missile while the missile is some distance from the target. This provides ample time to properly detonate the missile explosive charge to destroy the target, for example. The number of the arrays placed about the periphery of the missile body will depend on the particular application.

It is understood that the above-described embodiments are merely illustrative of the possible specific embodiments which may utilize the principles of the present invention. Other arrangements may be devised in accordance with these principles by those skilled in the art without departing from the scope of the invention.

APPENDIX

Figure 6:
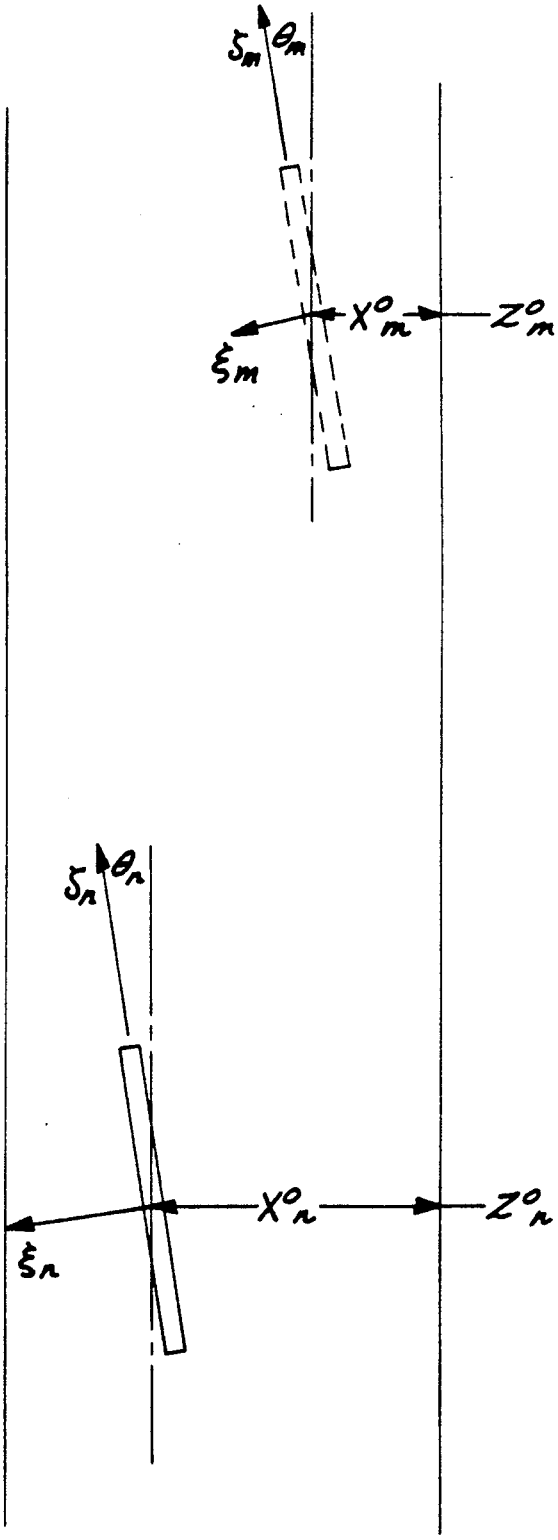
FIG. 6 is a diagrammatic illustration of the positions and orientations of compound slots.

The relations which connect the quantities of equations 4 and 5 are:

$$B_{ni} = \frac{K_{2,n}h_n^*}{K_{1,n}} V_{ni}^s \tag{8}$$

$$C_{ni} = \frac{K_{2,n}h_n}{K_{1,n}} V_{ni}^s \tag{9}$$

with $$V_{n1}^s = \frac{K_{1,n}h_n^*}{1 + K_{2,n}h_nh_n^*} A_n \tag{10}$$

$$V_{n2}^s = \frac{K_{1,n}h_n}{1 + K_2h_nh_n^*} D_n \tag{11}$$

$$\frac{V_{n3}^s}{V_n^s} = \frac{j}{4f_3 \cdot \sin k_ol_n(1 + k_2h_nh_n^*)} \cdot \sum_{m=1}^{N} \frac{V_m^s}{V_n^s} [\sin(\theta_m - \theta_n)I_{3,m} - \cos(\theta_m - \theta_n)I_{4,m}] \tag{12}$$

in which (see FIG. 6)

$$I_{3,m} = \int_{-l_m}^{l_m} \left( \frac{\zeta_n - l_n}{\xi_n} \frac{e^{-jkor1}}{r_1} + \frac{\zeta_n + l_n}{\xi_n} \frac{e^{-jkor2}}{r_2} - 2\cos k_ol_n \cdot \frac{\zeta_n}{\xi_n} \frac{e^{-jkor}}{r} \right) \cos \frac{\pi\zeta_m}{2l_m} d\zeta_m$$

$$I_{4,m} = \int_{-l_m}^{l_m} \left( \frac{e^{-jkor1}}{r_1} + \frac{e^{-jkor2}}{r_2} - \cos k_ol_n \frac{e^{-jkor}}{r} \right) \cdot \cos \frac{\pi\zeta_m}{2l_m} d\zeta_m$$

$$r_1 = [(x_m^o + \zeta_m \sin\theta_m - x_n^o - l_n \sin\theta_n)^2 + (z_m^o + \zeta_m \cos\theta_m - z_n^o - l_n \cos\theta_n)^2]^{\frac{1}{2}}$$

$$r = [(x_m^o + \zeta_m \sin\theta_m - x_n^o) + (z_m^o + \zeta_m \cos\theta_m - z_n^o)^2]^{\frac{1}{2}}$$

$$r_2 = [(x_m^o + \zeta_m \sin\theta_m - x_n^o + l_n \sin\theta_n)^2 + (z_m^o + \zeta_m \cos\theta_m - z_n^o + l_n \cos\theta_n)^2]^{\frac{1}{2}}$$

$$\xi_n = \left[ \overset{1}{w}_x(x_m^o + \zeta_m \sin\theta_m - x_n^o) + \overset{1}{w}_z(z_m^o + \zeta_m \cos\theta_m - z_n^o) \right] \cdot$$

$$\overset{1}{w}_{\xi n} = (x_m^o + \zeta_m \sin\theta_m - x_n^o)\cos\theta_n - (z_m^o + \zeta_m \cos\theta_m - z_n^o)\sin\theta_n$$

$$\zeta_n = \left[ \overset{1}{w}_x(x_m^o + \zeta_m \sin\theta_m - x_n^o) + \overset{1}{w}_z(z_m^o + \zeta_m \cos\theta_m - z_n^o) \right] \cdot$$

$$\overset{1}{w}_{\zeta n} = (x_m^o + \zeta_m \sin\theta_m - x_n^o)\sin\theta_n + (z_m^o + \zeta_m \cos\theta_m - z_n^o)\,\theta_n$$

in $\mathbf{1}_{wx}$ w indicates a vector quantity. In this case, a unit vector in the x direction.

and lastly, $$\frac{V_{n,4}^s}{V_n^s} = -j\frac{\pi/2}{0.609} \cdot \frac{\sqrt{\epsilon_r}}{(\gamma_{20}/k)(k_oa)(k_ob)(k_ol_n)} \cdot \frac{e^{\frac{\gamma 20}{k} \cdot kd}}{(1 + k_{2,n}h_nh_n^*)} \cdot \tag{13}$$

$$\left\{ k_ol_{n-1}\frac{V_{n-1}^s}{V_n^s}\left[N(\theta_{n-1} + ji')\frac{e^{-j2\pi x_{n-1}}}{a} + N(\theta_{n-1} - ji')\cdot\frac{e^{j2\pi x_{n-1}}}{a}\right]\cdot\left[N(\theta_n + ji')\frac{e^{j2\pi x_n}}{a} + N(\theta_n - ji')\frac{e^{-j2\pi x_n}}{a}\right] + \right.$$

$$\left. k_ol_{n+1}\frac{V_{n+1}^s}{V_n^s}\left[N(\theta_{n+1} + ji')\frac{e^{j2\pi x_{n+1}}}{a} + N(\theta_{n+1} - ji')\cdot\frac{e^{-j2\pi x_{n+1}}}{a}\right]\cdot\left[N(\theta_n + ji')\frac{e^{-j2\pi x_n}}{a} + N(\theta_n - ji')\frac{e^{j2\pi x_n}}{a}\right]\right\}$$

-continued $$\text{in which } N(z) = \cos z \frac{\cos(kl_n \cdot \sin z)}{\left(\frac{4l_n}{\lambda} \cdot \sin x\right)^2 - 1}$$

and the real angle i' is defined by $$\cosh i' = \frac{\lambda}{a}, \sinh i' = \frac{\gamma_{20}}{k} \text{ and } \gamma_{20} = +\sqrt{\left(\frac{2\pi}{a}\right)^2 - k^2}$$

What is claimed is:

1. A travelling wave array antenna for producing an array beam in a predetermined direction inclined from the broadside normal direction, comprising:

a rectangular waveguide defined by first and second conductive broadwalls and first and second conductive narrow walls;

means for exciting said waveguide with an excitation signal having a prescribed wavelength and propagating in a $TE_{10}$ mode through said waveguide in a propagation direction from a first end of said waveguide towards a second end of said waveguide;

means for terminating said waveguide at said second end thereof;

a series of spaced-apart compound slots formed in said first broadwall generally along the longitudinal centerline of said first broadwall, wherein;

the length of each of said slots is resonant;

intermittent ones of said slots are positioned on opposite sides of said longitudinal centerline with their lengthwise dimensions oriented at selected angles with respect to said longitudinal centerline;

at least two successive ones of said intermittent slots being offset from said longitudinal centerline on the same side; and, the angle parameter of said angularly oriented slots being preselected to effectuate a distribution of the phase and amplitude of said excitation signal which is effective to produce the array beam pointed in said predetermined direction.

2. The array antenna as set forth in claim 1, wherein said resonant length of each of said compound slots is defined as one-half of said prescribed wavelength of said excitation signal.

3. The array antenna as set forth in claim 2, wherein said center-to-center spacing between each adjacent pair of said slots is approximately one-half of the characteristic wavelength of said waveguide.

4. The array antenna as set forth in claim 1, wherein said means for terminating said waveguide comprises a matched load.

5. The array antenna as set forth in claim 1, wherein said waveguide is filled with a dielectric material having a relative dielectric constant greater than one.

6. The array antenna as set forth in claim 1, wherein said center-to-center spacing between each adjacent pair of said slots is equal.

* * * * *